US010421294B2

(12) United States Patent
Matsuura et al.

(10) Patent No.: US 10,421,294 B2
(45) Date of Patent: Sep. 24, 2019

(54) RECORDING APPARATUS AND RECORDING METHOD

(71) Applicant: CANON KABUSHIKI KAISHA, Tokyo (JP)

(72) Inventors: Shingo Matsuura, Tokyo (JP); Yoshiaki Murayama, Tokyo (JP); Jun Yasutani, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/379,917

(22) Filed: Dec. 15, 2016

(65) Prior Publication Data

US 2017/0173976 A1 Jun. 22, 2017

(30) Foreign Application Priority Data

Dec. 16, 2015 (JP) ..... 2015-245377

(51) Int. Cl.

| | |
|---|---|
| ***B41J 11/00*** | (2006.01) |
| ***B41J 2/01*** | (2006.01) |
| ***B41J 2/21*** | (2006.01) |
| ***B41M 7/00*** | (2006.01) |

(52) U.S. Cl.

CPC ..... *B41J 11/0015* (2013.01); *B41J 2/01* (2013.01); *B41J 2/2114* (2013.01); *B41M 7/0018* (2013.01)

(58) Field of Classification Search

None

See application file for complete search history.

(56) References Cited

U.S. PATENT DOCUMENTS

| | | | | |
|---|---|---|---|---|
| 8,740,374 | B2 * | 6/2014 | Seno | B41J 2/2132 347/102 |
| 2007/0013759 | A1 * | 1/2007 | Kadomatsu | B41J 2/2114 347/102 |
| 2010/0156971 | A1 * | 6/2010 | Ikeda et al. | B41J 29/38 347/9 |
| 2014/0192121 | A1 * | 7/2014 | Bannai | B41J 2/2114 347/101 |

FOREIGN PATENT DOCUMENTS

| | | |
|---|---|---|
| JP | 2006-205465 A | 8/2006 |
| JP | 2007-276400 A | 10/2007 |

* cited by examiner

*Primary Examiner* — Alejandro Valencia

(74) *Attorney, Agent, or Firm* — Canon U.S.A., Inc. IP Division

(57) ABSTRACT

A recording apparatus includes an ink applying unit which applies, based on image data, ink containing coloring material, on a recording medium to record an image for the image data; a treatment-solution applying unit which applies treatment solution containing acid for agglomerating components in the ink, at and around an ink application position on the recording medium; a neutralizing unit which applies neutralizing solution for neutralizing the acid, on the recording medium on which the treatment solution and the ink have been applied; and a determining unit which, based on the image data and position data for application of the treatment solution, determines a neutralizing-solution application region so that only at least a part of a region in which only the treatment solution is applied on the recording medium is set as the neutralizing-solution application region. The neutralizing unit applies the neutralizing solution in the determined neutralizing-solution application region.

18 Claims, 17 Drawing Sheets

FIG. 8A

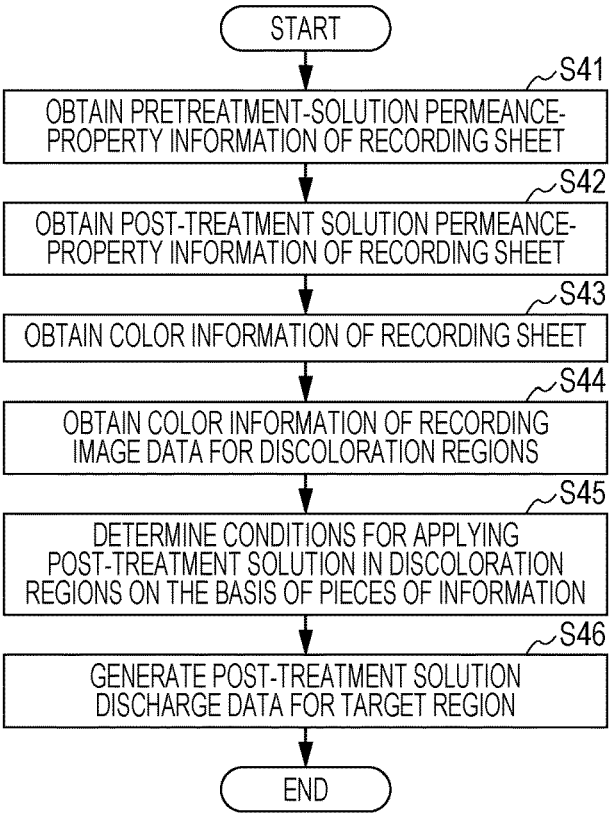

FIG. 8B

| | PERMEANCE LEVEL A | PERMEANCE LEVEL B | WHITE-COLOR LEVEL |
|---|---|---|---|
| RECORDING SHEET 1 | Lv1 (EASY TO BE PERMEATED) | Lv1 (EASY TO BE PERMEATED) | Lv1 (WHITE) |
| RECORDING SHEET 2 | Lv1 (EASY TO BE PERMEATED) | Lv2 (NORMAL) | Lv1 (WHITE) |
| RECORDING SHEET 3 | Lv2 (NORMAL) | Lv2 (NORMAL) | Lv1 (WHITE) |
| RECORDING SHEET 4 | Lv3 (DIFFICULT TO BE PERMEATED) | Lv2 (NORMAL) | Lv2 (YELLOW) |
| RECORDING SHEET 5 | Lv3 (DIFFICULT TO BE PERMEATED) | Lv3 (DIFFICULT TO BE PERMEATED) | Lv1 (WHITE) |

RECORDING APPARATUS AND RECORDING METHOD

BACKGROUND OF THE INVENTION

Field of the Invention

The present disclosure relates to a recording apparatus and a recording method.

Description of the Related Art

Inkjet recording apparatuses are known as liquid discharge apparatuses which record images by discharging liquid such as ink on a record medium such as paper. Recently, to achieve improvement of quality of printed characters and high definition of images by suppressing ink blurs, inkjet recording apparatuses employ a method of applying a pretreatment solution that is to react with ink, in advance on a recording medium (recording paper). According to this method, a pretreatment solution which causes a coloring material contained in ink to be insolubilized or agglomerated is applied, and ink droplets containing the coloring material are then discharged by using a recording head. Thus, agglomeration of the coloring material in ink is produced on a recording sheet. Accordingly, occurrence of an ink blur may be suppressed, achieving high-quality characters and high-definition images. As a method of applying a pretreatment solution, a method using an applying roller and a method of, like ink, discharging the pretreatment solution on a recording sheet by using a discharge head have been proposed.

The method of discharging a pretreatment solution by using a discharge head makes it possible to arrange the pretreatment solution only at or near a position at which an ink droplet is discharged. However, to surely agglomerate a coloring material contained in ink, it is necessary to discharge the pretreatment solution in advance at a position at which an ink droplet is to be discharged on a recording sheet. To do this, in consideration of a discharge misalignment error of an ink droplet, it is necessary to discharge the pretreatment solution in a wide area around a position at which an ink droplet is discharged. To discharge the pretreatment solution in a wide area as described above, Japanese Patent Laid-Open No. 2007-276400 discloses a method of expanding data about discharge of ink droplets and discharging a pretreatment solution on the basis of the obtained data about discharge of the pretreatment solution.

In contrast, for inkjet recording apparatuses, an increase in speed of a recording operation as well as an increase in quality of images is desired. For example, Japanese Patent Laid-Open No. 2006-205465 discloses a method in which an organic acid is used for the pretreatment solution in order that ink is more rapidly agglomerated and fixed on a recording sheet.

However, when an organic acid is used for the pretreatment solution, the organic acid contained in the pretreatment solution that remains on a recording sheet may produce a phenomenon (hereinafter referred to as a "yellowing phenomenon") in which the recording sheet becomes yellow over time. This phenomenon is likely to be noticeable especially when, as described in Japanese Patent Laid-Open No. 2007-276400, a pretreatment solution is discharged in a wide area around a position at which an ink droplet is discharged or a necessary amount or more of the pretreatment solution is discharged in order to surely obtain the agglomeration action. That is, a large amount of the organic acid may remain on a recording sheet, and a yellowing phenomenon may conspicuously occur, resulting in reduction in image quality.

SUMMARY OF THE INVENTION

The present disclosure provides a recording apparatus and a recording method which maintain high quality of images while an increase in speed of a recording operation is achieved.

The present disclosure provides a recording apparatus including an ink applying unit, a treatment-solution applying unit, a neutralizing unit, and a determining unit. The ink applying unit includes a discharge opening for discharging ink containing a coloring material. The ink applying unit applies, based on image data, the ink from the discharge opening onto a recording medium so as to record an image indicated by the image data. The treatment-solution applying unit applies a treatment solution at and around a position at which the ink is applied on the recording medium. The treatment solution contains an acid for agglomerating components contained in the ink. The neutralizing unit includes a discharge opening for discharging a neutralizing solution for neutralizing the acid. The neutralizing unit applies the neutralizing solution from the discharge opening on the recording medium on which the treatment solution and the ink have been applied. The determining unit determines a neutralizing-solution application region in which the neutralizing solution is applied, based on the image data and data indicating a position at which the treatment solution is applied on the recording medium. The determining is performed in such a manner that at least part of a region in which the treatment solution is applied on the recording medium and in which the ink is not applied on the recording medium is set as the neutralizing-solution application region and that the other region on the recording medium is not set as the neutralizing-solution application region. The neutralizing unit applies the neutralizing solution in the neutralizing-solution application region determined by the determining unit.

Further features of the present disclosure will become apparent from the following description of exemplary embodiments with reference to the attached drawings.

BRIEF DESCRIPTION OF THE DRAWINGS

FIGS. 8A and 8B are diagrams for describing a process of generating post-treatment solution discharge data.

DESCRIPTION OF THE EMBODIMENTS

Figure 1:
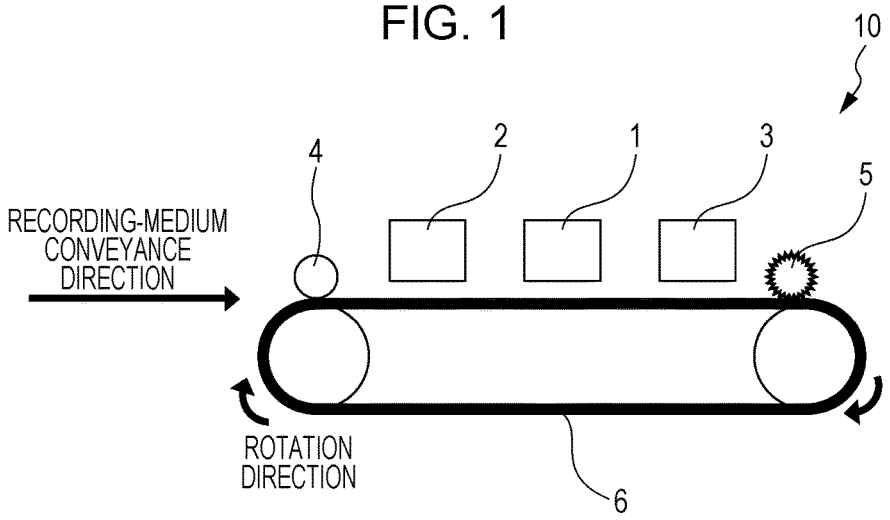
FIG. 1 is a schematic diagram illustrating the configuration of an inkjet recording apparatus according to a first embodiment.

Referring to the drawings, embodiments of the present disclosure will be described in detail below. Herein, an inkjet recording apparatus will be described as an example. Examples of ink include color ink containing a coloring material, such as pigment or dye, and a solution containing a metal for producing electronic circuits. A description will be made below by taking a recording sheet as an exemplary recording medium. A recording medium may be not only paper but also, for example, a plastic plate or cloth. FIG. 1 is a schematic diagram illustrating the configuration of an inkjet recording apparatus which serves as a liquid discharge apparatus, according to a first embodiment.

An inkjet recording apparatus (hereinafter simply referred to as a "recording apparatus") 10 according to the first embodiment includes a recording head (ink discharge head) 1, a pretreatment-solution discharge head 2, and a post-treatment solution discharge head 3. Each of the heads which is provided with discharge openings may discharge supplied liquid. The recording apparatus 10 also includes a feed roller 4, a sheet discharging roller 5, and a sheet conveying belt 6 stretched between sheet conveying rollers. In the recording apparatus 10, the pretreatment-solution discharge head 2 discharges a reaction solution that reacts with ink, as a pretreatment solution on a recording sheet (recording medium) that is fed by the feed roller 4 and that is conveyed by the sheet conveying belt 6. Then, the recording head 1 discharges ink so that an image is recorded. The post-treatment solution discharge head 3 discharges, on the recording sheet, a post-treatment solution that serves as a neutralizing solution for neutralizing acid contained in the pretreatment solution. Then, the sheet discharging roller 5 discharges the recording sheet from the recording apparatus 10. The recording head 1 may be a line print head in which multiple discharge opening arrays are aligned and fixed in the direction orthogonal to the direction in which a recording sheet is conveyed, or may be a serial print head with which serial recording is performed by using a carriage reciprocating in the direction orthogonal to the direction in which a recording sheet is conveyed.

The recording head 1 is provided with multiple discharge opening arrays for multiple color inks. Each of the discharge opening arrays has a configuration in which multiple discharge openings are arrayed in a given direction. In the first embodiment, four color inks of cyan (C), magenta (M), yellow (Y), and black (K) are available, but the number of colors is not limited to four. Ink of each color contains at least a coloring material (pigment), a polymer, a solvent, and an activator. In contrast, the pretreatment solution contains an organic acid that causes the coloring material and the polymer contained in ink to be insolubilized or agglomerated. In the first embodiment, a pretreatment solution containing at least a glutaric acid, a solvent, and an activator is used. However, a pretreatment solution containing an organic acid, such as citric acid, malic acid, or malonic acid, may be used. The post-treatment solution is a neutralizing solution producing neutralization of the organic acid in order to suppress a phenomenon (hereinafter referred to as a "yellowing phenomenon") in which a recording sheet becomes yellow due to the organic acid in the pretreatment solution. As long as the post-treatment solution may contain an ingredient for neutralizing an organic acid, the post-treatment solution is not limited to one containing a specific ingredient.

Figure 2:
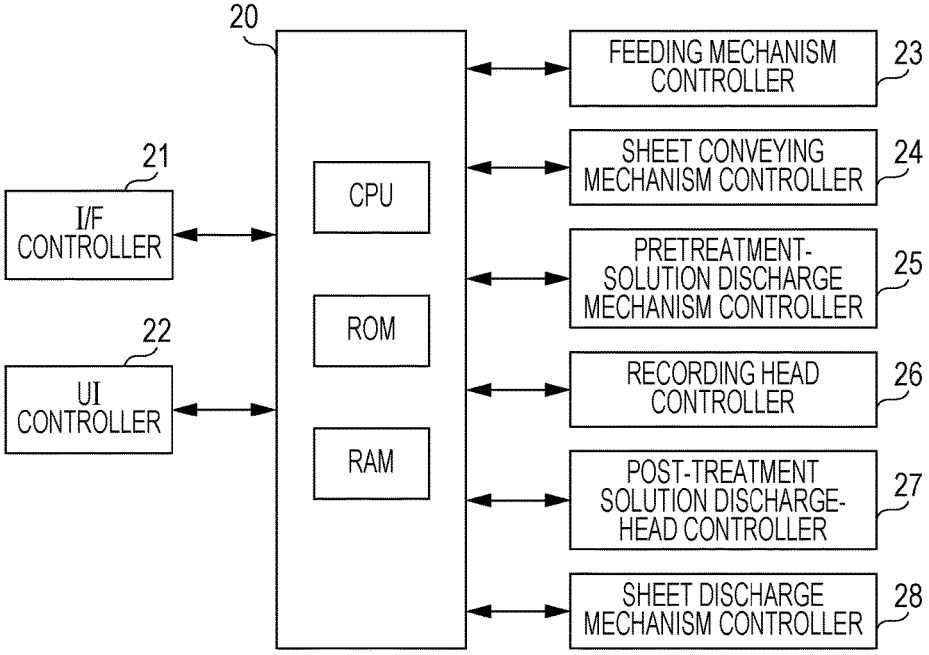
FIG. 2 is a block diagram illustrating the configuration of a control system of the inkjet recording apparatus.

FIG. 2 is a block diagram illustrating the configuration of a control system of the recording apparatus according to the first embodiment.

A system controller 20 which includes a central processing unit (CPU), a read-only memory (ROM), and a random-access memory (RAM) functions as a controller that exerts control over the entire recording apparatus 10. The CPU performs data calculation described below. The ROM functions as a memory for storing programs executed by the system controller to control the units, as described below. The RAM functions as a memory for temporarily storing data that is read to be used in calculation performed by the CPU or calculation results. An interface (I/F) controller 21 exerts control so that communication with an external apparatus or a media storing recording image data is performed and that image data and commands are transmitted. A user interface (UI) controller 22 displays a menu, a setting screen, and the state of the recording apparatus 10, and controls reception of operations from a user. A feeding mechanism controller 23, a sheet conveying mechanism controller 24, and a sheet discharge mechanism controller 28 control the feed roller 4, the sheet conveying belt 6, and the sheet discharging roller 5, respectively, on the basis of instructions from the system controller 20 so that a recording sheet is fed, conveyed, and discharged. A recording head controller 26 controls the recording head 1 on the basis of instructions from the system controller 20 so that an image based on image data received by the I/F controller 21 is recorded on a recording sheet. A pretreatment-solution discharge mechanism controller 25 controls the pretreatment-solution discharge head 2 on the basis of instructions from the system controller 20 so that the pretreatment solution is discharged on a recording sheet. A post-treatment solution discharge-head controller 27 controls the post-treatment solution discharge head 3 on the basis of instructions from the system controller 20 so that the post-treatment solution is discharged on a recording sheet.

Figure 3:
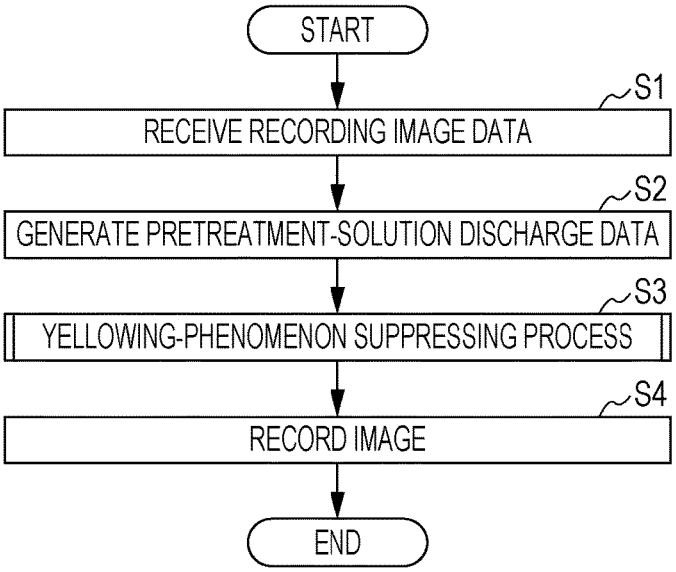
FIG. 3 is a flowchart of a recording operation performed in the inkjet recording apparatus.

Referring to FIG. 3, a recording operation performed by the recording apparatus according to the first embodiment will be described. FIG. 3 is a flowchart illustrating the recording operation performed by the recording apparatus according to the first embodiment.

Image data is received through the I/F controller 21 from an external apparatus or the like connected to the recording apparatus 10 (step S1), and the system controller 20 generates pretreatment-solution discharge data on the basis of the received image data (step S2). The system controller 20 performs a yellowing-phenomenon suppressing process for suppressing a yellowing phenomenon occurring due to the pretreatment solution, on the basis of the received image data and the generated pretreatment-solution discharge data (step S3), and generates post-treatment solution discharge data. That is, the yellowing-phenomenon suppressing process is a process in which a region (hereinafter referred to as a "discoloration region") in which a yellowing phenomenon is to occur is specified on the basis of a condition for printing a recording image (condition for discharging ink) and a condition for applying the pretreatment solution, and in which a condition for applying the post-treatment solution in the specified discoloration region is determined. In specification of a discoloration region, a region in which the post-treatment solution is to be applied is specified so that the following conditions are satisfied: at least part of a region in which the pretreatment solution has been applied on a recording sheet and in which ink has not been applied is set as a region in which the post-treatment solution is to be applied; and the other region on the recording sheet is not set as a region in which the post-treatment solution is to be applied. The specific processes in the yellowing-phenomenon suppressing process will be described below. Finally, the image is recorded on the recording sheet on the basis of the image data, the pretreatment-solution discharge data, and the post-treatment solution discharge data (step S4), and the recording operation ends.

Figure 4A:
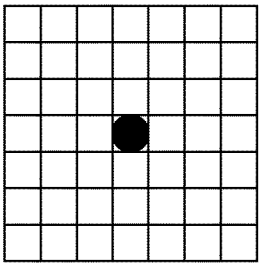
FIGS. 4A to 4F are diagrams illustrating exemplary dot arrangements for pretreatment-solution discharge data.
Figure 4B:
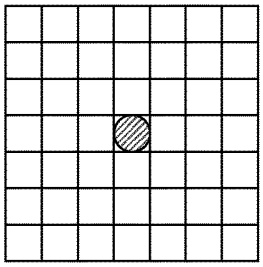
Figure 4C:
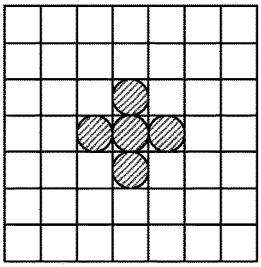
Figure 4D:
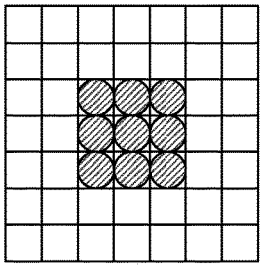
Figure 4E:
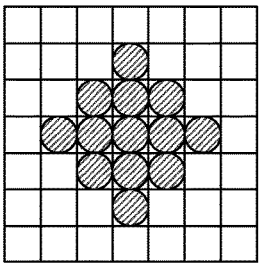
Figure 4F:
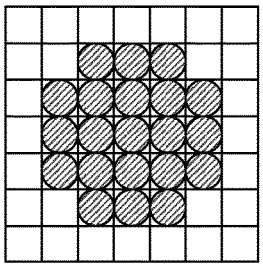

Referring to FIGS. 4A to 4F, the pretreatment-solution discharge data generated by the system controller will be described. FIG. 4A is a diagram illustrating an exemplary dot arrangement for image data. FIGS. 4B to 4F are diagrams illustrating some exemplary dot arrangements for the pretreatment-solution discharge data.

The system controller 20 determines a region in which the pretreatment solution is to be discharged, on the basis of the position of a dot in image data. At that time, a region in which the pretreatment solution is to be discharged is determined in consideration of accuracy in discharge of liquid from the recording head 1 and the pretreatment-solution discharge head 2, and conveyance accuracy of the sheet conveying belt 6 in order that an ink droplet discharged on the basis of image data is surely in contact with the pretreatment solution on the recording sheet. FIGS. 4B to 4F illustrate regions in which the pretreatment solution is to be discharged and which are determined on the basis of the position of a dot in image data (one dot) in FIG. 4A. FIGS. 4B to 4F illustrate the discharge regions in the order from the smallest to the largest.

When multi-colored image data is present, dots obtained by taking the logical OR of image data of the colors may be used to calculate a region in which the pretreatment solution is to be discharged. Alternatively, a region in which the pretreatment solution is to be discharged may be calculated by obtaining, through calculation, dot arrangements for pretreatment solution data which correspond to image data of the colors, and taking the logical OR of the results.

Three exemplary yellowing-phenomenon suppressing processes performed in the above-described recording operation of the recording apparatus according to the first embodiment will be described.

First Yellowing-Phenomenon Suppressing Process

A first yellowing-phenomenon suppressing process is a process in which isolated dots described below are detected among the dots in image data, and in which discoloration regions are specified from the distribution of the isolated dots to generate the post-treatment solution discharge data. Referring to the flowchart in FIG. 5, the first yellowing-phenomenon suppressing process will be described.

Steps S11 and S12

Figure 6A:
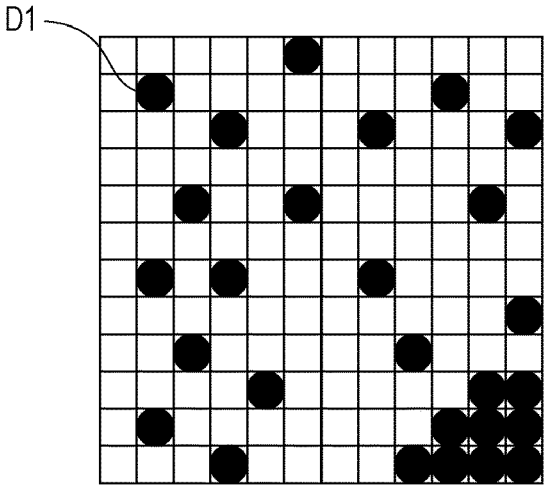
FIGS. 6A and 6B are diagrams illustrating exemplary dot arrangements for describing the first yellowing-phenomenon suppressing process.
Figure 6B:
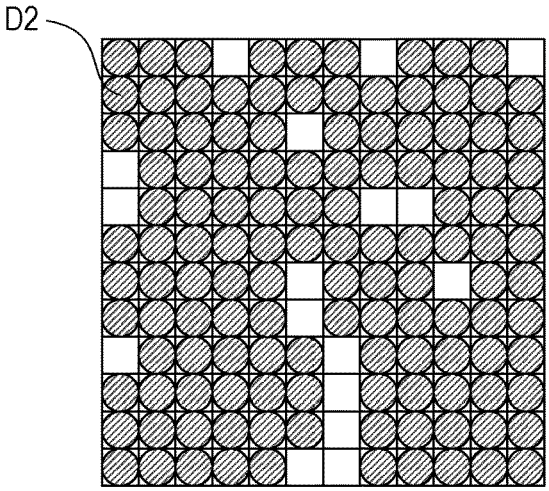

From a memory in which image data is stored, image data for a unit region (hereinafter referred to as a "target region") that is to be processed is obtained in the image region. Similarly, from a memory in which pretreatment-solution discharge data is stored, pretreatment-solution discharge data for the target region is obtained. FIG. 6A illustrates an exemplary dot arrangement for the obtained image data, and FIG. 6B illustrates an exemplary dot arrangement for the obtained pretreatment-solution discharge data. FIG. 6A illustrates a dot arrangement for image data for a target region whose size is 12×12 pixels, and illustrates the dot arrangement obtained after a logical OR operation is performed on multi-colored image data. FIG. 6B illustrates a dot arrangement which is indicated in the pretreatment-solution discharge data and which corresponds to the dot arrangement for the image data in FIG. 6A. Specifically, FIG. 6B illustrates a dot arrangement obtained in such a manner that, according to the method illustrated in FIG. 4D, nine dots D2 for pretreatment-solution discharge data are arranged for each of the dots D1 in the image data in FIG. 6A (that is, expansion is made by one dot in each of the eight radial directions). The size of a target region is not limited to 12×12 pixels as illustrated in FIGS. 6A and 6B.

Step S13

Figure 7A:
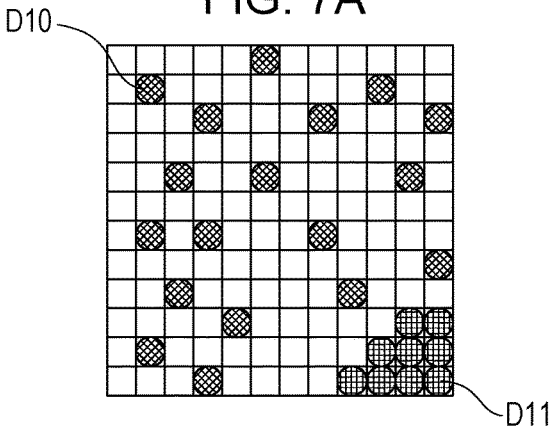
FIGS. 7A to 7C are diagrams illustrating exemplary dot arrangements for describing the first yellowing-phenomenon suppressing process.

Isolated dots are detected among the dots in the image data for the target region. In the first embodiment, when attention is focused on a certain dot in the image data, if no adjacent dots are present in the eight radial directions, the dot is detected as an isolated dot. If an adjacent dot is present, the certain dot is detected as a non-isolated dot. FIG. 7A illustrates a dot arrangement which is indicated in the image data illustrated in FIG. 6A and in which classification into isolated dots D10 and non-isolated dots D11 is indicated.

Step S14

The isolated dots detected in step S13 are counted, and it is determined whether or not the number K of isolated dots is equal to or larger than a given number N. Presence of many isolated dots causes dots of the pretreatment solution to be exposed, and therefore means presence of many regions in which a yellowing phenomenon is easy to be conspicuous. Therefore, it is determined whether or not a yellowing phenomenon is likely to be viewed in the target region, on the basis of the number K of isolated dots in the target region. That is, when the number of isolated dots is equal to or larger than the given number, it is determined that a yellowing phenomenon is likely to be viewed and that it is necessary to perform the yellowing-phenomenon suppressing process. If the number of isolated dots is less than the given number, it is determined that a yellowing phenomenon is unlikely to be viewed and that it is unnecessary to perform the yellowing-phenomenon suppressing process. The threshold (given number) N for the number K of isolated dots may be appropriately set in accordance with the size of a target region. For example, when the size is 12×12 pixels as described above, the threshold is set to nine dots.

Step S15

Figure 7B:
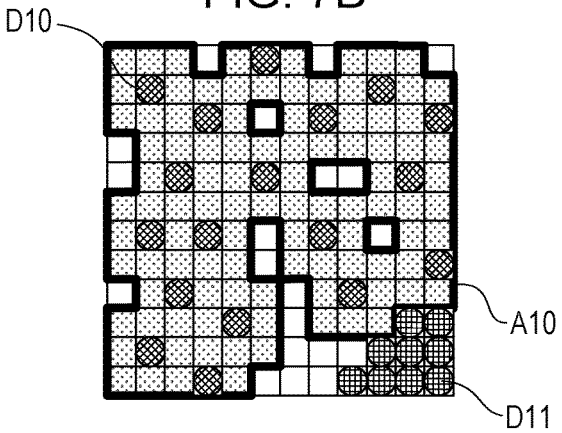

If it is determined that the number K of isolated dots is equal to or larger than the given number N in step S14, a region near each isolated dot is specified as a discoloration region. At that time, final specification of a discoloration region is performed in accordance with how dots of the pretreatment solution are arranged (applied) around the isolated dot. FIG. 7B illustrates, as an exemplary discoloration region, a discoloration region A10 specified on the basis of the dot arrangement for the image data illustrated in FIG. 6A and the dot arrangement for the pretreatment-solution discharge data illustrated in FIG. 6B. In this example, the discoloration region A10 matches a region in which the pretreatment solution is applied around the isolated dots D10. However, depending on characteristics of the pretreatment solution, the region may be smaller or larger than that in which the pretreatment solution is applied.

Step S16

A process of determining a condition for discharging the post-treatment solution is performed, and how the post-treatment solution is to be applied in the discoloration region A10 specified in step S15 is determined. Referring to the flowchart in FIG. 8A, the process of determining a condition for discharging the post-treatment solution will be described.

In the process of determining a condition for discharging the post-treatment solution, pretreatment-solution permeance-property information and post-treatment solution permeance-property information of the recording sheet are obtained (steps S41 and S42). The pretreatment-solution permeance-property information indicates to what extent the pretreatment solution diffuses on a recording sheet and permeates the recording sheet, and also indicates in which region a yellowing phenomenon occurs. The pretreatment-solution permeance-property information is used to suppress a yellowing phenomenon in an appropriate region. The post-treatment solution permeance-property information indicates to what extent the post-treatment solution diffuses on a recording sheet and permeates the recording sheet. The post-treatment solution permeance-property information is used to achieve consumption of the post-treatment solution which is not excessive and not insufficient. Therefore, these types of information are necessary to determine to what extent the post-treatment solution is to be applied (that is, a region in which the post-treatment solution is to be applied).

Color information of the recording sheet and color information of the image data for the discoloration region are obtained (steps S43 and S44). The color information of a recording sheet literally indicates the color of the recording sheet. The color information of image data is obtained from a condition for applying ink. For example, when the color of a recording sheet is a color with which a yellowing phenomenon is not easily viewed (for example, yellow), the amount of consumption of the post-treatment solution may be reduced. The extent of occurrence of a yellowing phenomenon also depends on how many dots of ink are applied for one dot of the pretreatment solution. Therefore, the optimal amount of post-treatment solution may be set on the basis of color information of recording data. Consequently, these types of information are necessary to determine the amount of post-treatment solution which is to be applied (that is, the amount of application of the post-treatment solution).

In the first embodiment, the pretreatment-solution permeance-property information, the post-treatment solution permeance-property information, and the color information of the recording sheet are obtained from a recording-sheet information setting table in which the pieces of information are registered in advance, on the basis of the recording sheet type selected by a user through the UI controller 22. FIG. 8B illustrates an exemplary recording-sheet information setting table. Instead of using the recording-sheet information setting table, a color ink having a given surface tension is dropped on the recording sheet, and an optical sensor is used to read a region in which the color ink spreads. On the basis of the area of the region, permeance-property information of the pretreatment solution and that of the post-treatment solution may be set. The color information of the recording sheet may be set by reading the color of the recording sheet by using an optical sensor.

Figure 7C:
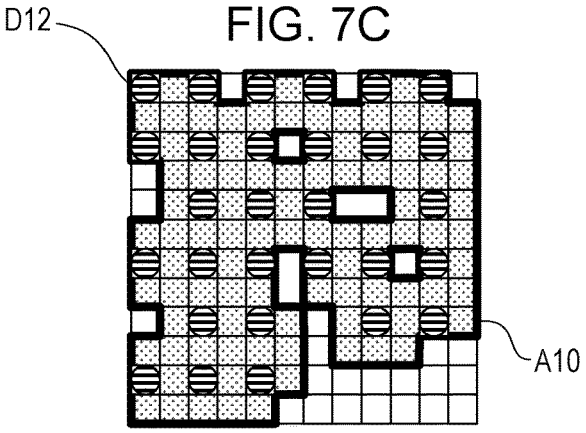
Figure 9A:
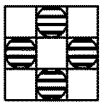
FIGS. 9A to 9D are diagrams illustrating exemplary dot arrangements for the post-treatment solution discharge data.
Figure 9B:
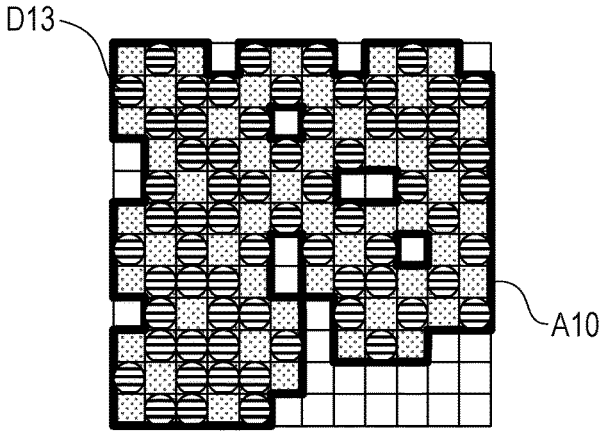
Figure 9C:
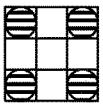
Figure 9D:
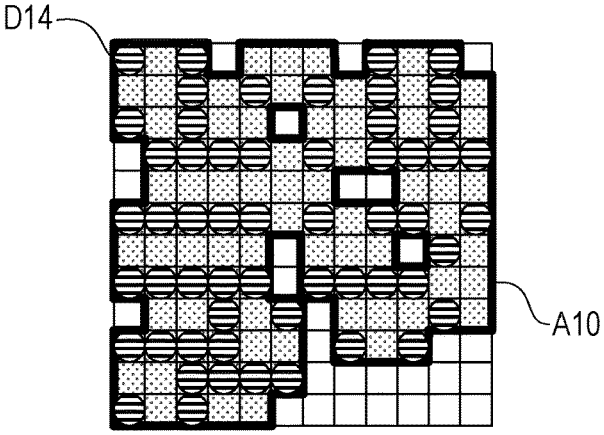

How the post-treatment solution is to be applied in a discoloration region is determined on the basis of the obtained pieces of information (step S45), and post-treatment solution discharge data for the target region is generated from the determination result (step S46). FIG. 7C illustrates an exemplary dot arrangement for the generated post-treatment solution discharge data, and illustrates an example in which dots D12 of the post-treatment solution are uniformly arranged in the discoloration region A10 in FIG. 7B. FIGS. 9A to 9D also illustrate other exemplary dot arrangements for the post-treatment solution discharge data. FIGS. 9A and 9C illustrate two exemplary basic arrangement patterns of dots of the post-treatment solution, and illustrate how dots of the post-treatment solution are arranged for an isolated dot (at the center of the nine dots). FIGS. 9B and 9D illustrate exemplary dot arrangements for the post-treatment solution discharge data which are obtained by applying the basic arrangement patterns of dots which are illustrated in FIGS. 9A and 9C, respectively, to each isolated dot in the discoloration region A10 in FIG. 7B.

Steps S17 and S18

If it is determined that the process of determining a condition for discharging the post-treatment solution has been performed in step S16, or if it is determined that the number K of isolated dots in the target region is less than the given number N in step S14, it is determined whether or not the entire image region for the image data has been processed. If it is determined that the entire image region has not been processed, the target region shifts to the next one, and steps S11 to S16 are repeatedly performed. If it is determined that the entire image region has been processed in step S17, that is, if it is determined that post-treatment solution discharge data for the entire image region has been generated, the yellowing-phenomenon suppressing process ends.

Thus, various types of post-treatment solution discharge data may be generated in accordance with the condition for applying the pretreatment solution, the condition for printing a recording image (condition for discharging ink), and characteristics of a recorded sheet.

Second Yellowing-Phenomenon Suppressing Process

Figure 5:
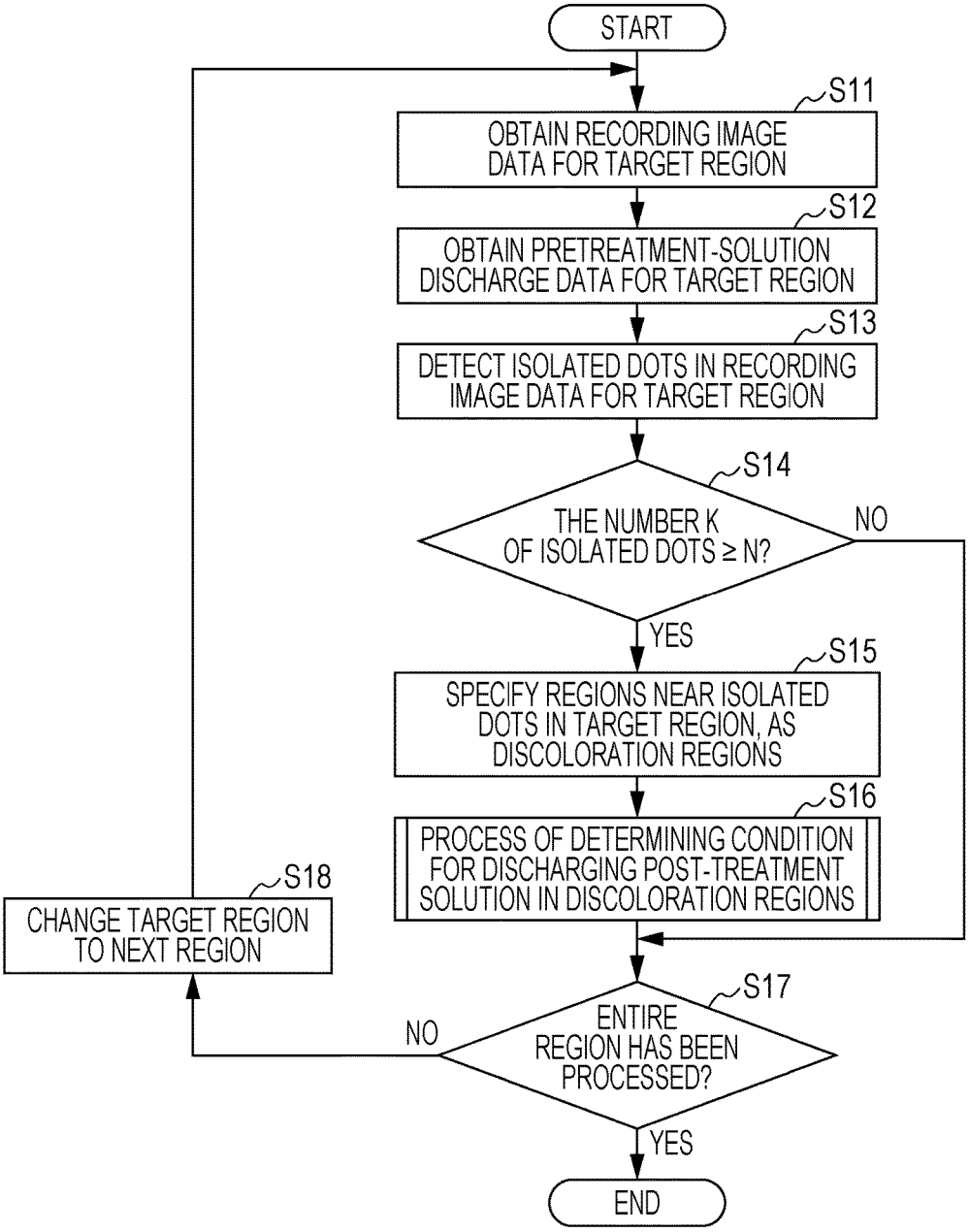
FIG. 5 is a flowchart of a first yellowing-phenomenon suppressing process.
Figure 10:
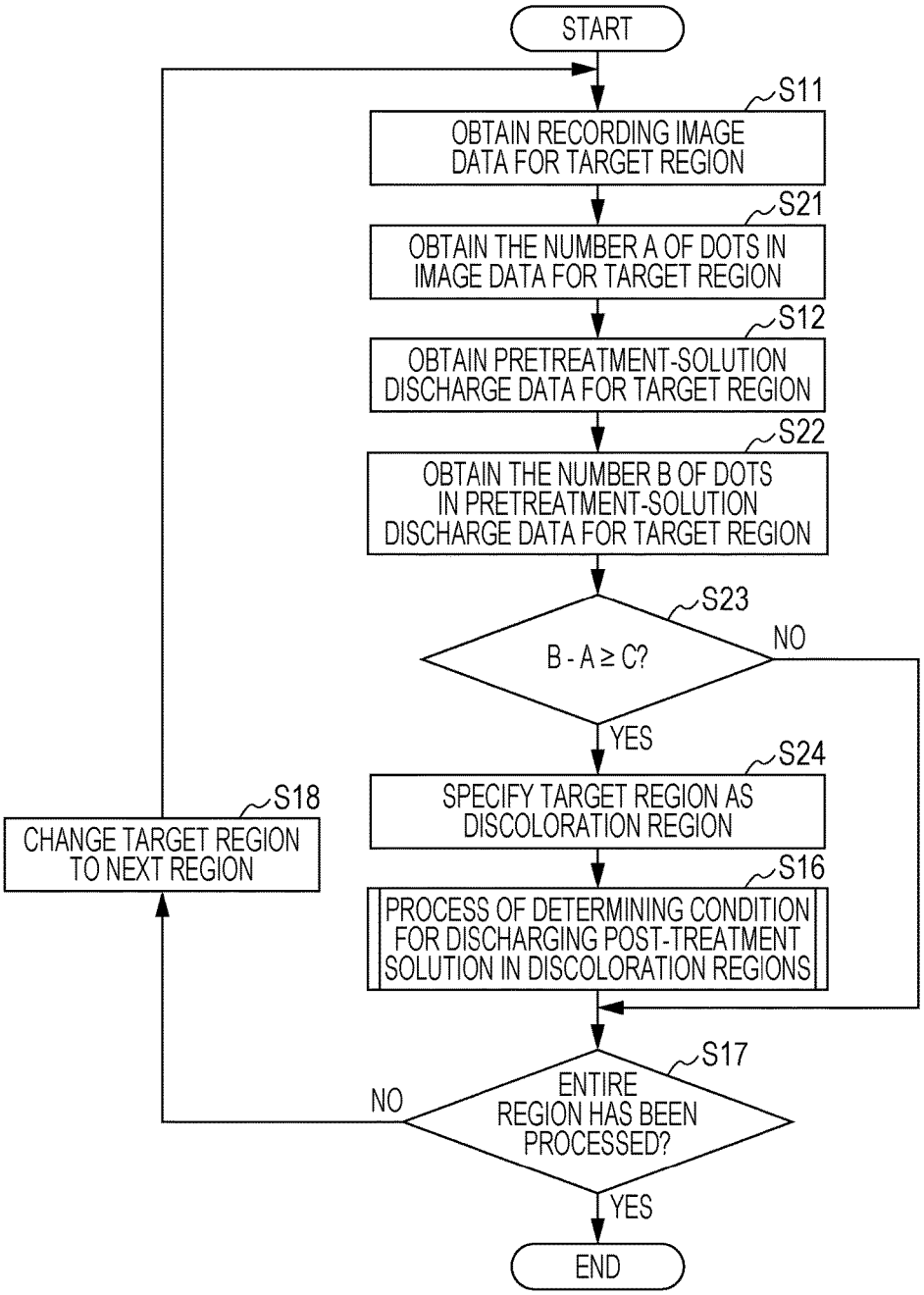
FIG. 10 is a flowchart of a second yellowing-phenomenon suppressing process.

A second yellowing-phenomenon suppressing process is a process in which discoloration regions are specified on the basis of the difference between the number of dots in image data and the number of dots in pretreatment-solution discharge data, and in which post-treatment solution discharge data is generated. Referring to the flowchart in FIG. 10, the second yellowing-phenomenon suppressing process will be described below. Processes similar to those in the first yellowing-phenomenon suppressing process illustrated in the flowchart in FIG. 5 are designated with identical reference characters, and will not be described.

Figure 11A:
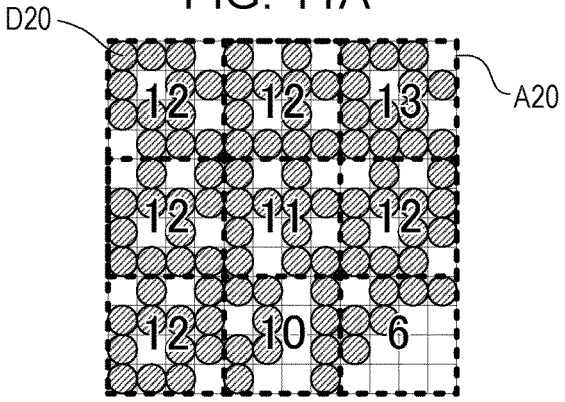
FIGS. 11A to 11C are diagrams for illustrating exemplary dot arrangements for describing the second yellowing-phenomenon suppressing process.

In the second yellowing-phenomenon suppressing process, when image data for a target region is obtained in step S11, the number A of dots in the image data for the target region is obtained (step S21). Similarly, when pretreatment-solution discharge data for the target region is obtained in step S12, the number B of dots in the pretreatment-solution discharge data for the target region is obtained (step S22). The number of dots is obtained by subtracting the number A of dots in the image data from the number B of dots in the pretreatment-solution discharge data. FIG. 11A illustrates an exemplary arrangement of dots D20 obtained through an exclusive OR operation between the image data and the pretreatment-solution discharge data when the size of a target region is 12×12 pixels. That is, the number of dots D20 illustrated in FIG. 11A corresponds to the number of dots (B-A, which is hereinafter referred to as a subtraction dot count) obtained by subtracting the number A of dots in the image data from the number B of dots in the pretreatment-solution discharge data in the target region.

It is determined whether or not the subtraction dot count (B-A) in the target region is equal to or larger than a given number C (step S23). If it is determined that the subtraction dot count is equal to or larger than the given number C, the target region is specified as a discoloration region (step S24).

Figure 11B:
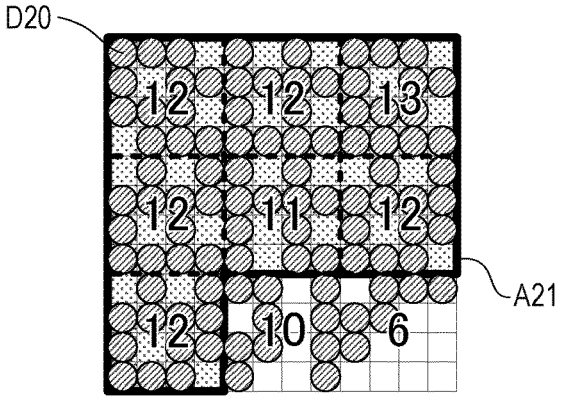

In the first embodiment, to specify a discoloration region in a more detailed manner, a target region is divided into multiple dot count regions having a given size, and it is determined whether or not the subtraction dot count is equal to or larger than the given number C for each dot count region. A dot count region in which it is determined that the subtraction dot count is equal to or larger than the given number C (that is, the area obtained by subtracting the area of a region in which ink has been discharged from the area of a region in which the pretreatment solution has been discharged is equal to or larger than a given value) is specified as a discoloration region. In FIG. 11A, the subtraction dot count for each dot count region A20 is illustrated as a number in the case where the size of a dot count region is 4×4 pixels. A larger number illustrated in FIG. 11A indicates that a yellowing phenomenon is more likely to occur in the corresponding dot count region A20. FIG. 11B illustrates an example in which, among the dot count regions A20 in FIG. 11B, dot count regions whose subtraction dot counts are equal to or larger than 11 dots are specified as a discoloration region A21. In this example, a subtraction dot count is used as information reflecting the amount of unreacted acid.

Figure 11C:
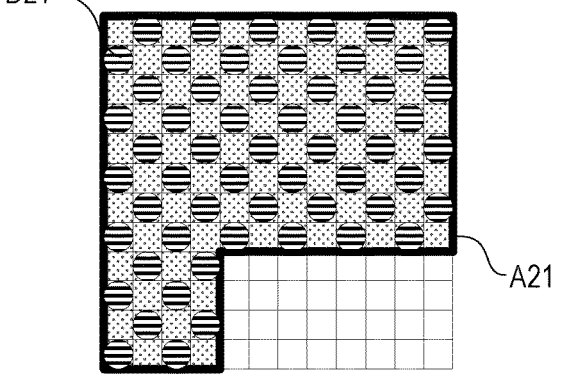

Similarly to the first yellowing-phenomenon suppressing process, how the post-treatment solution is to be applied in a discoloration region thus specified may be determined in accordance with the condition for applying the pretreatment solution, the condition for printing a recording image, and characteristics of a recording medium. FIG. 11C illustrates an example in which dots D21 of the post-treatment solution are uniformly arranged in the discoloration region A21 in FIG. 11B. In this case, the post-treatment solution is also applied at positions at which both of ink and the pretreatment solution are applied and which are located in the discoloration region.

Third Yellowing-Phenomenon Suppressing Process

Figure 12:
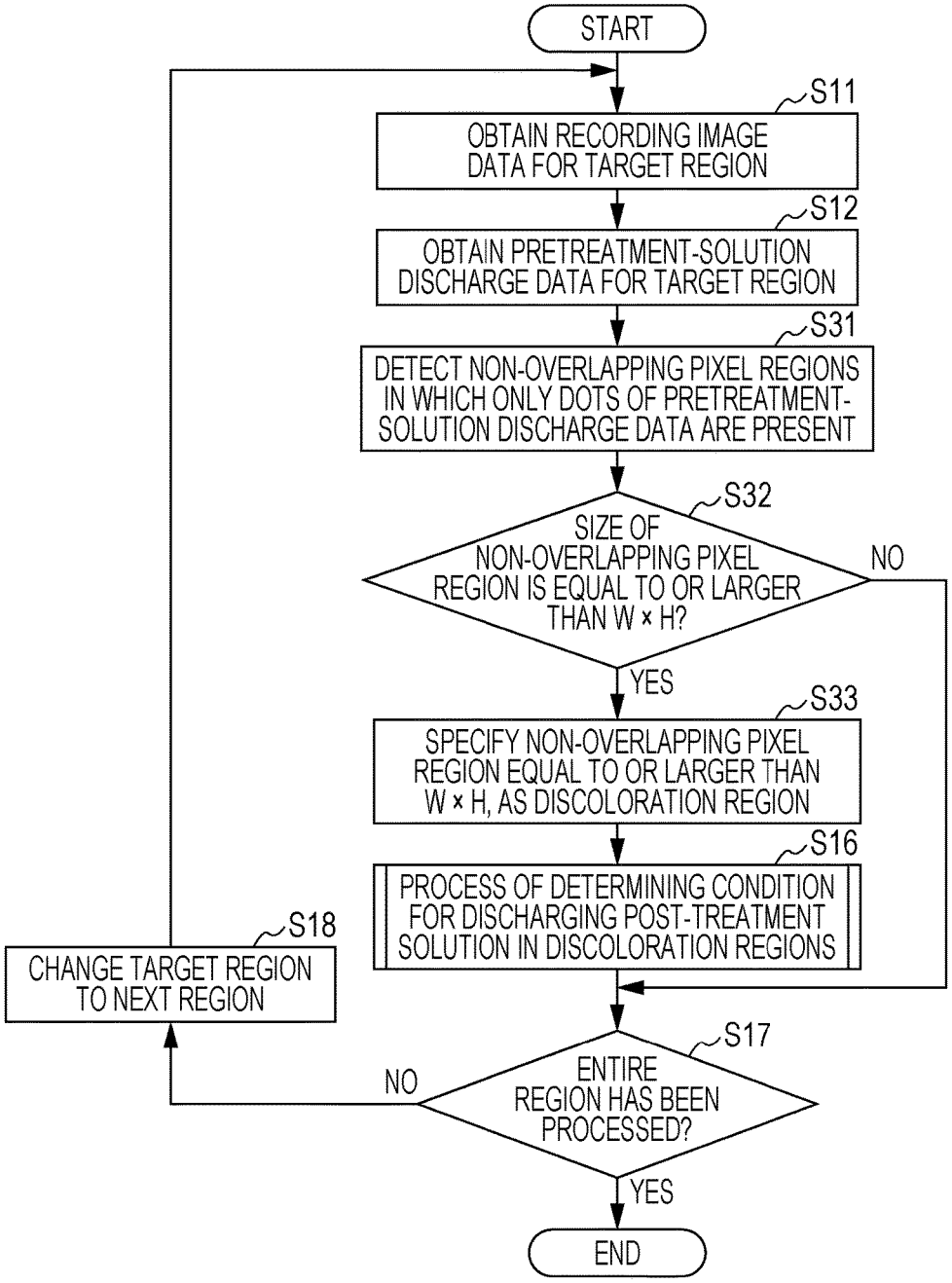
FIG. 12 is a flowchart of a third yellowing-phenomenon suppressing process.

A third yellowing-phenomenon suppressing process is a process in which a pixel region in which only dots for pretreatment-solution discharge data are present is detected, in which a discoloration region is specified from the size of the pixel region, and in which post-treatment solution discharge data is generated. Referring to the flowchart in FIG. 12, the third yellowing-phenomenon suppressing process will be described below. Processes similar to those in the first yellowing-phenomenon suppressing process illustrated in the flowchart in FIG. 5 are designated with identical reference characters, and will not be described.

Figure 13A:
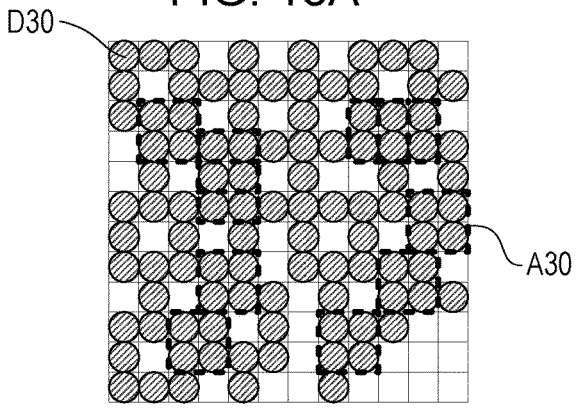
FIGS. 13A to 13C are diagrams illustrating exemplary dot arrangements for describing the third yellowing-phenomenon suppressing process.

In the third yellowing-phenomenon suppressing process, when recording image data and pretreatment-solution discharge data for a target region is obtained in steps S11 and S12, non-overlapping pixel regions in which only dots for the pretreatment-solution discharge data are present in a non-overlapping manner are detected in the target region (step S31). FIG. 13A illustrates an exemplary arrangement of dots D30 obtained through an exclusive OR operation between the image data and the pretreatment-solution discharge data when the size of a target region is 12×12 pixels. That is, a pixel region in which dots D30 are present in FIG. 13A corresponds to a non-overlapping pixel region in which dots for the recording image data are not present and in which only dots for the pretreatment-solution discharge data are present in a non-overlapping manner.

Figure 13B:
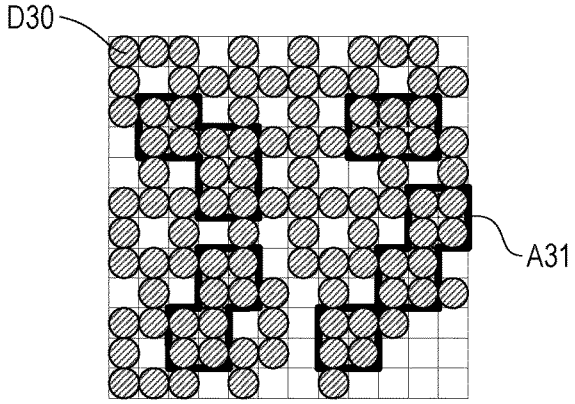

It is determined whether or not a non-overlapping pixel region whose size is equal to or larger than given pixels W×H is present (step S32). If it is determined that a non-overlapping pixel region whose size is equal to or larger than the given pixels W×H (W and H indicate numbers more than one) is present, the non-overlapping pixel region is specified as a discoloration region (step S33). A region A30 illustrated in FIG. 13A corresponds to a non-overlapping pixel region of 2×2 pixel size. FIG. 13B illustrates an example in which a non-overlapping pixel region of 2×2 pixel size or larger is specified as a discoloration region A31. The size of a non-overlapping pixel region specified as a discoloration region is not limited to the size of 2×2 pixels or larger which is described above, and may be changed appropriately on the basis of the condition for applying the pretreatment solution and the condition for printing a recording image. For example, it is assumed that the size of a non-overlapping pixel region is set to, for example, 1×1 pixel.

In this case, a portion of a region in which the pretreatment solution has been applied on a recording medium and in which ink has not been applied is set as a region in which the post-treatment solution is to be applied, and the other portion in the region in which the pretreatment solution has been applied on the recording medium is not set as a region in which the post-treatment solution is to be applied.

Figure 13C:
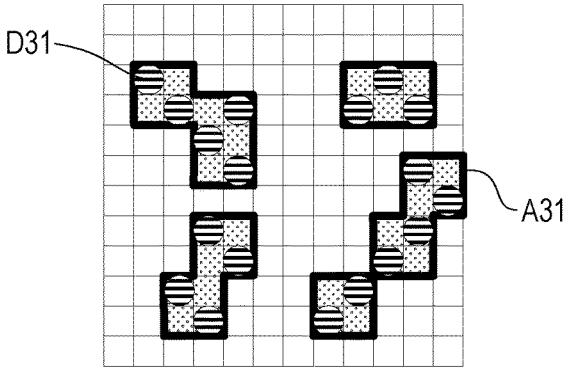

Similarly to the first yellowing-phenomenon suppressing process, how the post-treatment solution is to be applied in the discoloration region thus specified may be determined in accordance with the condition for applying the pretreatment solution, the condition for printing a recording image, and characteristics of a recording medium. FIG. 13C illustrates an example in which dots D31 of the post-treatment solution are uniformly arranged in the discoloration regions A31 in FIG. 13B.

Fourth Yellowing-Phenomenon Suppressing Process

When a large margin in a region in which the pretreatment solution is applied needs to be provided for an object in image data, a yellowing phenomenon will occur around the object. A fourth yellowing-phenomenon suppressing process is a process for suppressing such a yellowing phenomenon around an object in image data. Referring to exemplary dot arrangements in FIGS. 14A to 14E, the fourth yellowing-phenomenon suppressing process will be described below.

Figure 14A:
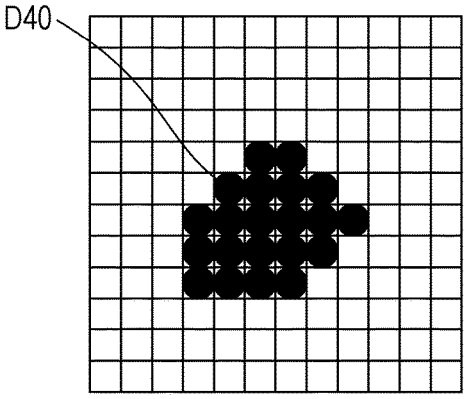
FIGS. 14A to 14E are diagrams illustrating exemplary dot arrangements for describing a fourth yellowing-phenomenon suppressing process.
Figure 14B:
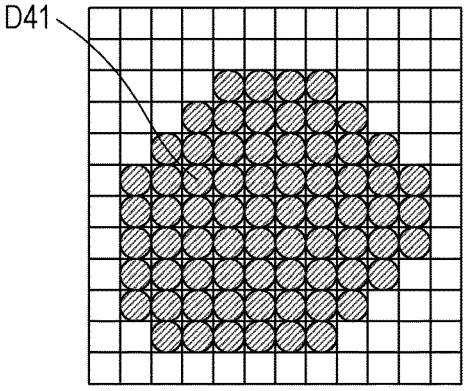
Figure 14C:
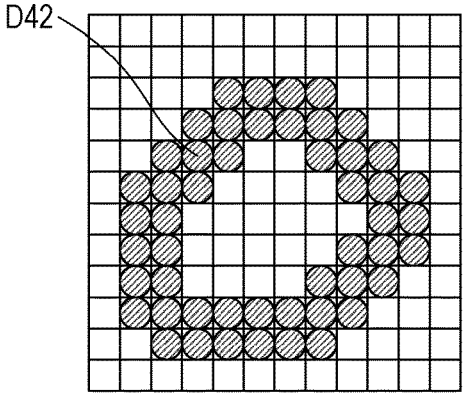
Figure 14D:
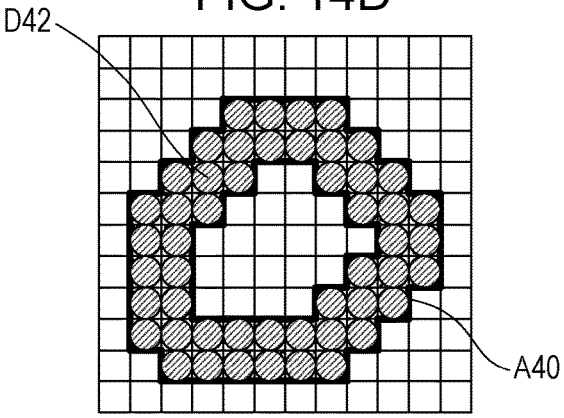

FIG. 14A illustrates an exemplary arrangement of dots D40 for image data. FIG. 14B illustrates an example in which dots D41 for pretreatment-solution discharge data are arranged for each of the dots D40 for the image data in FIG. 14A according to the method illustrated in FIG. 4F. Dots D42 illustrated in FIG. 14C are obtained by performing mask processing on the pretreatment-solution discharge data in FIG. 14B by using the image data in FIG. 14A. Therefore, a pixel region in which the dots D42 are present corresponds to a pixel region in which only dots for the pretreatment-solution discharge data are present, that is, a region that is included in the region in which the pretreatment solution is applied and that is not set as a region in which ink is discharged. A region A40 illustrated in FIG. 14D matches the pixel region in which the dots D42 in FIG. 14C are present, and represents a discoloration region formed around the object in image data in FIG. 14A.

Figure 14E:
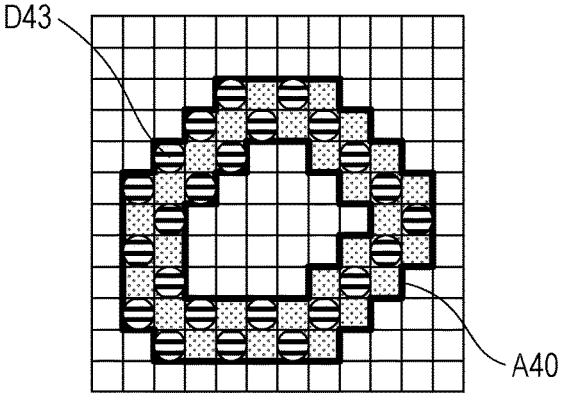

Similarly to the first yellowing-phenomenon suppressing process, how the post-treatment solution is to be applied in such a discoloration region formed around an object in image data may be determined in accordance with the condition for applying the pretreatment solution, the condition for printing a recording image, and characteristics of a recording medium. FIG. 14E illustrates an example in which dots D43 of the post-treatment solution are uniformly arranged in the discoloration region A40 in FIG. 14D.

Fifth Yellowing-Phenomenon Suppressing Process

To improve the gloss and fastness of a print product, a post-treatment solution which contains a colorless and transparent polymer which is agglomerated by an organic acid in the pretreatment solution may be used. A fifth yellowing-phenomenon suppressing process is a process in which a condition for applying a post-treatment solution containing such a polymer is determined. The fifth yellowing-phenomenon suppressing process may be achieved by combining the first to fourth yellowing-phenomenon suppressing processes with one another. Thus, not only suppression of a yellowing phenomenon but also improvement of the gloss and fastness of a print product may be achieved.

Figure 15A:
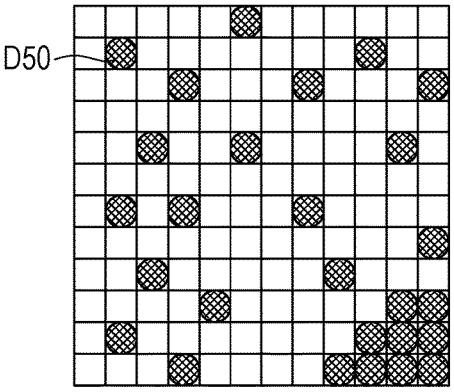
FIGS. 15A to 15D are diagrams illustrating exemplary dot arrangements for describing a fifth yellowing-phenomenon suppressing process.
Figure 15B:
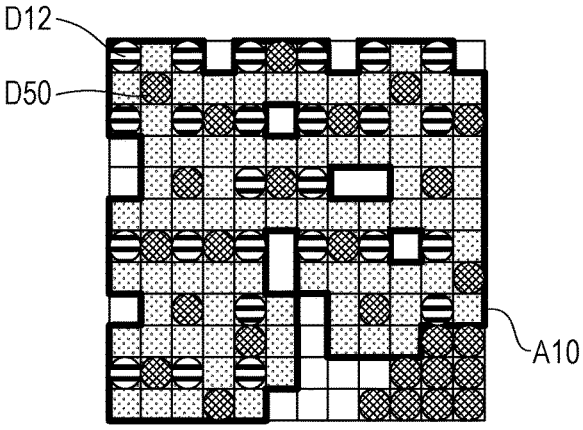
Figure 15C:
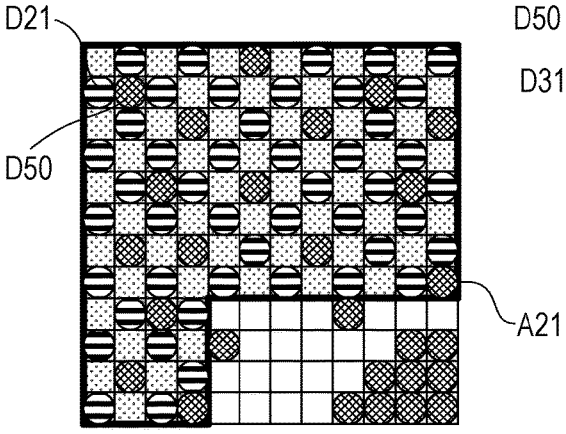
Figure 15D:
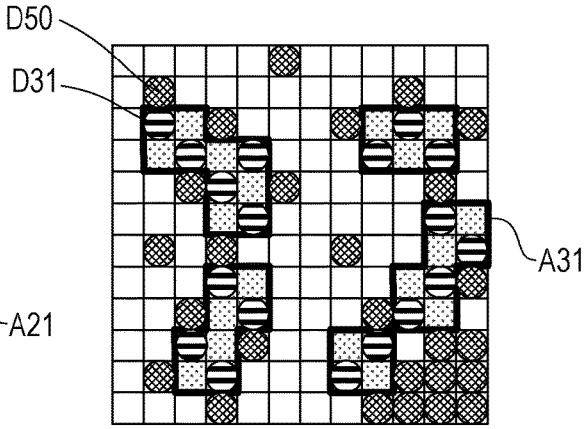

FIGS. 15A to 15D illustrate exemplary dot arrangements for post-treatment solution discharge data which are generated in the fifth yellowing-phenomenon suppressing process. FIG. 15A illustrates an exemplary arrangement in which one dot of the above-described post-treatment solution containing the polymer is applied in the same pixel region as that for each of the dots D1 of image data in FIG. 6A. As long as a necessary number of dots of the post-treatment solution are applied to improve the gloss and fastness of a print product, application of the post-treatment solution is not limited to one dot for each dot in image data. FIG. 15B illustrates an example in which the dots D12 of the post-treatment solution illustrated in FIG. 7C are arranged in combination with the dots D50 of the post-treatment solution containing the polymer which are illustrated in FIG. 15A. Similarly, FIGS. 15C and 15D illustrate examples in which the dots D21 of the post-treatment solution which are illustrated in FIG. 11C and the dots D31 illustrated in FIG. 13C, respectively, are arranged in combination with the dots D50 of the post-treatment solution containing the polymer which are illustrated in FIG. 15A.

In the above-described embodiment, the yellowing-phenomenon suppressing process is performed on the basis of data obtained by quantizing CMYK into binary. The yellowing-phenomenon suppressing process may be performed on the basis of multi-valued data which is constituted by red, green, and blue (RGB) inputs of image data and which is obtained before the quantization. That is, the yellowing-phenomenon suppressing process may be applied to both of data before the quantization and data after the quantization. When the pretreatment-solution discharge data is calculated on the basis of the data which is constituted by RGB inputs and which is obtained before the quantization, the post-treatment solution discharge data may be also calculated on the basis of the data before the quantization.

Figure 16A:
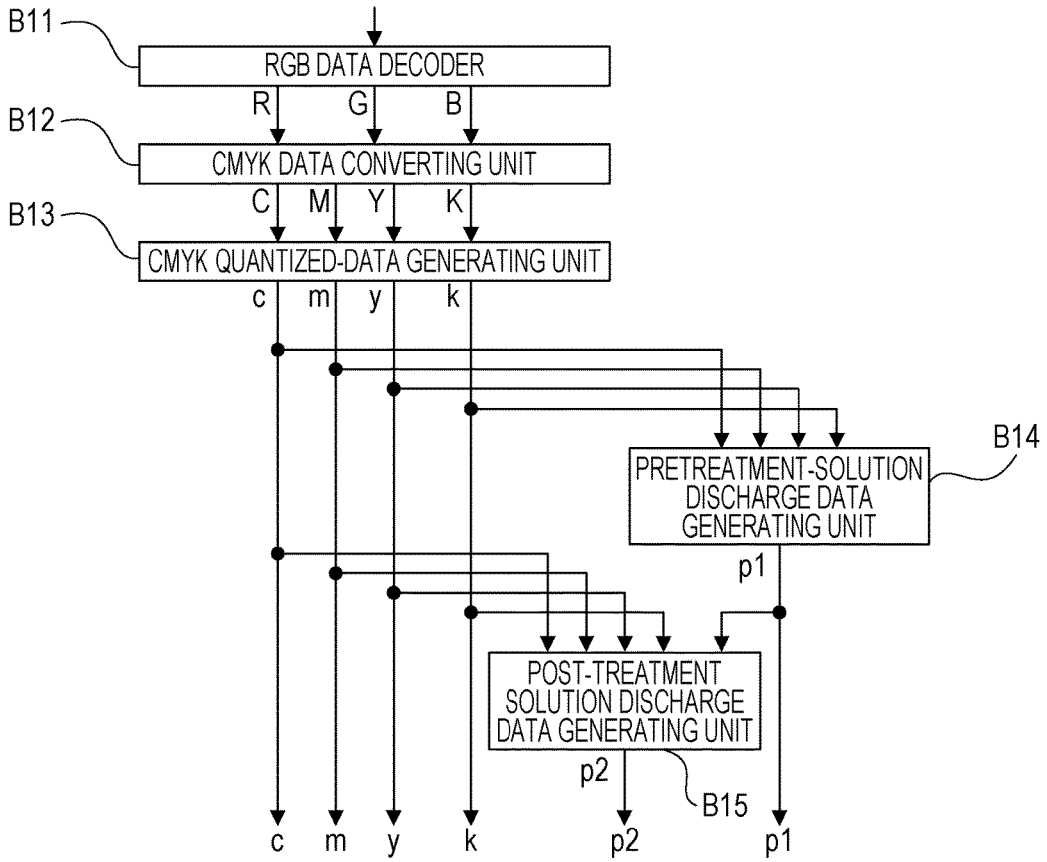
FIGS. 16A and 16B are block diagrams illustrating flows for generating data, which are performed by a system controller.
Figure 16B:
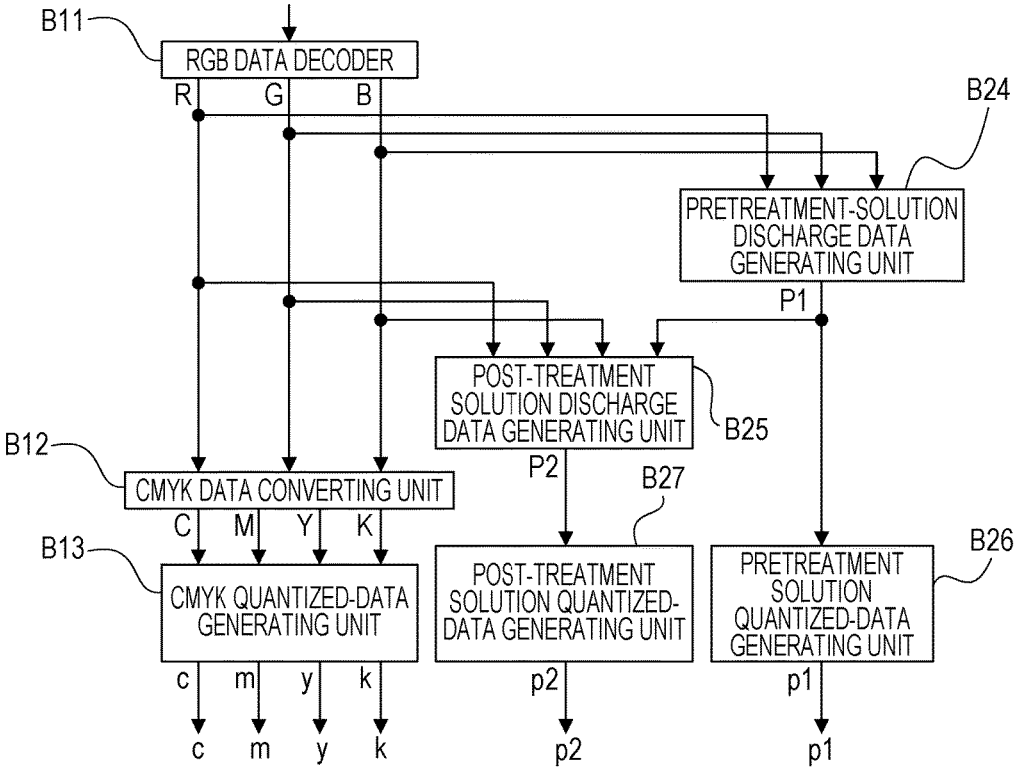

FIGS. 16A and 16B are block diagrams of data generation flows performed by the system controller. FIG. 16A illustrates a flow performed when the pretreatment-solution discharge data and the post-treatment solution discharge data are calculated on the basis of the data obtained by quantizing CMYK. FIG. 16B illustrates a flow performed when the pretreatment-solution discharge data and the post-treatment solution discharge data are calculated on the basis of RGB data before the quantization.

In the example illustrated in FIG. 16A, an RGB data decoder B11 decodes received image data into RGB data, and a CMYK data converting unit B12 converts the RGB data obtained through decoding, into data in the CMYK color space. A CMYK quantized-data generating unit B13 quantizes the CMYK data obtained through conversion, and a pretreatment-solution discharge data generating unit B14 generates pretreatment-solution discharge data from the quantized CMYK data. A post-treatment solution discharge data generating unit B15 generates post-treatment solution discharge data from the quantized CMYK data and the pretreatment-solution discharge data.

In the example in FIG. 16B, the RGB data decoder B11 performs decoding to obtain RGB data; a pretreatment-solution discharge data generating unit B24 generates pretreatment-solution discharge data from the RGB data obtained through decoding; and a pretreatment solution quantized-data generating unit B26 quantizes the pretreatment-solution discharge data. A post-treatment solution data generating unit B25 generates post-treatment solution discharge data from the RGB data and the pretreatment-solution discharge data before quantization, and a post-treatment solution quantized-data generating unit B27 quantizes the post-treatment solution discharge data. In contrast, similarly to the example in FIG. 16A, the CMYK data converting unit B12 converts RGB data into data in the CMYK color space, and the CMYK quantized-data generating unit B13 quantizes the resulting data as CMYK data.

Figure 17:
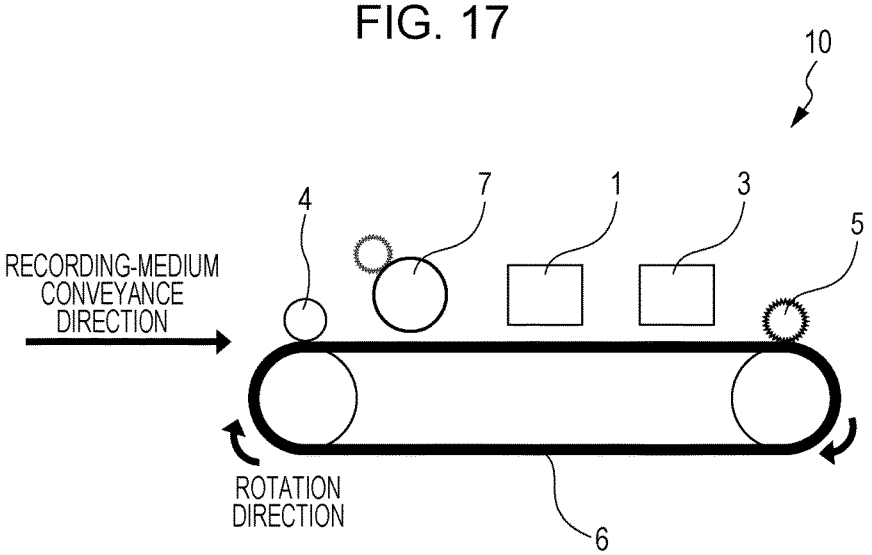
FIG. 17 is a schematic diagram illustrating the configuration of an inkjet recording apparatus according to a second embodiment.

FIG. 17 is a schematic diagram illustrating the configuration of an inkjet recording apparatus serving as a liquid discharge apparatus, according to a second embodiment.

Figure 18:
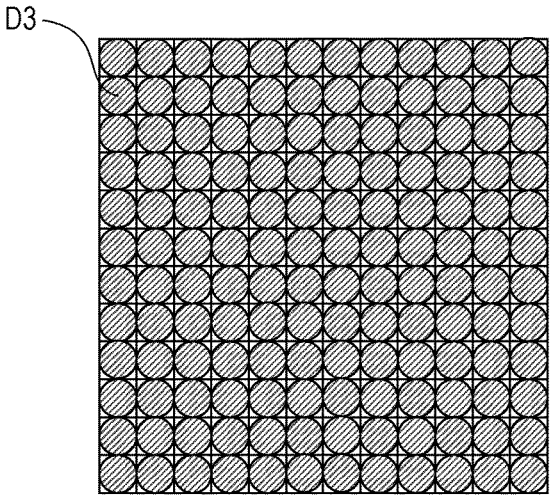
FIG. 18 is a diagram illustrating an exemplary dot arrangement for the pretreatment-solution discharge data.

The recording apparatus 10 according to the second embodiment is different from that in the first embodiment (see FIG. 1) in that a pretreatment solution applying roller 7 for gravure-offset printing is used to apply the pretreatment solution on a recording sheet. Therefore, the pretreatment solution is applied on the entire surface of a recording sheet by using the pretreatment solution applying roller 7. Accordingly, in the second embodiment, instead of the pretreatment-solution discharge data in which dots are selectively arranged as illustrated in FIG. 6B, pretreatment-solution discharge data (data for applying the pretreatment solution) in which dots D3 are arranged on the entire surface of a recording sheet as illustrated in FIG. 18 is generated. The recording apparatus 10 according to the second embodiment is different from that in the first embodiment in this point. The other configuration is similar to that in the first embodiment.

In the above description, a reaction solution for agglomerating ink is applied in a region in which ink is to be applied, prior to application of ink. However, if adequate reaction with ink may be made, after ink has been applied, a reaction solution may be applied on ink which has been applied on a recording sheet. After that, a neutralizing solution (the post-treatment solution in the above-described embodiment) for neutralizing unreacted acid may be applied on the recording sheet.

Further, in the above description, ink, a pretreatment solution, and a post-treatment solution are applied on a recording sheet without using another medium. However, after a pretreatment solution, ink, and a post-treatment solution are temporarily applied on a medium for transfer, an ink image and other applied materials on the medium for transfer may be transferred onto a recording sheet. In this case, neutralizing reaction is made on the medium for transfer. For example, in FIG. 1, the sheet conveying belt 6 is formed as a belt in such a manner as to be integrated with the medium for transfer. After each type of solution is applied onto the conveyed medium for transfer, an ink image on the medium for transfer may be transferred onto a recording sheet which is separately conveyed.

The present disclosure may provide a liquid discharge apparatus and a liquid discharge method which enable high image quality of an image to be maintained, while an increase in speed of a recording operation is achieved.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-245377 filed Dec. 16, 2015, which is hereby incorporated by reference herein in its entirety.

What is claimed is:

1. A recording apparatus comprising:

an obtaining unit configured to obtain image data for indicating an image to be formed on a recording medium;

an ink applying unit including a discharge opening for discharging ink containing a coloring material, the ink applying unit applying, based on the obtained image data, the ink from the discharge opening on the recording medium so as to form the image;

a treatment-solution applying unit configured to apply, on the recording medium, a treatment solution to a first region to which the ink is applied and to a second region to which the ink is not applied and which is outside of the first region, the treatment solution containing an acid for agglomerating components contained in the ink;

a setting unit configured to obtain information about an amount of unreacted acid for each unit region of the recording medium having a given size based on the obtained image data, and to set a neutralizing-solution application region based on the obtained information; and a neutralizing unit including a discharge opening for discharging a neutralizing solution for neutralizing the acid, the neutralizing unit applying the neutralizing solution from the discharge opening to the set neutralizing-solution application region on the recording medium, wherein the setting unit, in response to the amount of unreacted acid for a target unit region being less than a given amount, does not set the target unit region as the neutralizing-solution application region, and, in response to the amount of unreacted acid for the target unit region being not less than the given amount, sets the target unit region as the neutralizing-solution application region.

2. The recording apparatus according to claim 1, wherein the treatment-solution applying unit applies the treatment solution to an entire region of the recording medium prior to the ink applying unit applying the ink, the entire region on which the treatment solution is applied being larger than a region in which the ink applying unit is to apply the ink.

3. The recording apparatus according to claim 1, wherein the neutralizing-solution application region set by the setting unit includes a part in which both of the ink and the treatment solution are applied on the recording medium.

4. The recording apparatus according to claim 1, wherein the neutralizing solution contains a polymer which agglomerates due to the acid contained in the treatment solution.

5. The recording apparatus according to claim 1, wherein the setting unit further sets the neutralizing-solution application region in accordance with a type of the recording medium.

6. The recording apparatus according to claim 1, wherein the setting unit further sets the neutralizing-solution application region in accordance with a color of the recording medium.

7. A recording method comprising:

obtaining image data for indicating an image to be formed on a recording medium;

applying ink on a recording medium based on the obtained image data so as to form the image, the ink containing a coloring material;

applying a treatment solution, on the recording medium, to a first region to which the ink is applied and to a second region to which the ink is not applied and which is outside of the first region, the treatment solution containing an acid for agglomerating components contained in the ink;

obtaining information about an amount of unreacted acid for each unit region of the recording medium having a given size based on the obtained image data, and setting a neutralizing-solution application region based on the obtained information; and applying a neutralizing solution for neutralizing the acid to the set neutralizing-solution application region on the recording medium, wherein in response to the amount of unreacted acid for a target unit region being less than a given amount, the target unit region is not set as the neutralizing-solution application region, and, in response to the amount of unreacted acid for the target unit region being not less than the given amount, the setting sets the target unit region as the neutralizing-solution application region.

8. The recording method according to claim 7, wherein, in the applying a treatment solution, the treatment solution is applied to an entire region of the recording medium prior to the ink applying unit applying the ink, the entire region on which the treatment solution is applied being larger than a region in which the ink is applied in the applying ink.

9. The recording method according to claim 7, wherein the neutralizing solution contains a polymer which agglomerates due to the acid contained in the treatment solution.

10. The recording method according to claim 7, wherein, in the setting, the neutralizing-solution application region is set in accordance with a type of the recording medium.

11. The recording method according to claim 7, wherein, in the setting, the neutralizing-solution application region is set in accordance with a color of the recording medium.

12. A recording apparatus comprising:

an ink applying unit configured to include a discharge opening for discharging ink containing a coloring material, the ink applying unit applying, based on image data, the ink from the discharge opening onto a recording medium so as to record an image indicated by the image data;

a treatment-solution applying unit configured to apply a treatment solution at and around a position at which the ink is applied on the recording medium, the treatment solution containing an acid for agglomerating components contained in the ink;

a neutralizing unit configured to include a discharge opening for discharging a neutralizing solution for neutralizing the acid, the neutralizing unit applying the neutralizing solution from the discharge opening on the recording medium on which the treatment solution and the ink have been applied; and a determining unit configured to determine a neutralizing-solution application region in which the neutralizing solution is applied, based on the image data and data indicating a position at which the treatment solution is applied on the recording medium, the determining being performed in such a manner that at least a part of a region in which the treatment solution is applied on the recording medium and in which the ink is not applied on the recording medium is set as the neutralizing-solution application region and that another region on the recording medium is not set as the neutralizing-solution application region, wherein the neutralizing unit applies the neutralizing solution in the neutralizing-solution application region determined by the determining unit, wherein the determining unit obtains information about the amount of unreacted acid for each unit region having a given size, the unit region being obtained by dividing the recording medium, and wherein, based on the information, in response to the amount of unreacted acid for a target unit region being less than a given amount, the target unit region is not set as the neutralizing-solution application region, and, in response to the amount of unreacted acid for the target unit region being not less than the given amount, the target unit region is determined to be the neutralizing-solution application region.

13. The recording apparatus according to claim 1, wherein the second region is a surrounding region outside of the first region, and wherein the setting unit sets a portion of the surrounding region as the neutralizing-solution application region to which the neutralizing solution is applied.

14. The recording method according to claim 7, wherein the second region is a surrounding region outside of the first region, and wherein the setting includes setting a portion of the surrounding region as the neutralizing-solution application region to which the neutralizing solution is applied.

15. The recording apparatus according to claim 1, wherein a region outside of the first region surrounds the first region.

16. The recording method according to claim 7, wherein a region outside of the first region surrounds the first region.

17. The recording apparatus according to claim 1, further comprising a transfer unit configured to transfer, onto a recording sheet, the image on the recording medium on which the neutralizing-solution has been applied.

18. The recording method according to claim 7, wherein the image on the recording medium on which the neutralizing-solution has been applied is transferred onto a recording sheet.

* * * * *